US007439661B2

(12) United States Patent
Sato et al.

(10) Patent No.: US 7,439,661 B2
(45) Date of Patent: Oct. 21, 2008

(54) IMAGE DISPLAY APPARATUS HAVING ION PUMP INCLUDING PERMANENT MAGNET

(75) Inventors: Yasue Sato, Machida (JP); Masaru Kamio, Sagamihara (JP); Ihachiro Gofuku, Chigasaki (JP); Hisanori Tsuda, Atsugi (JP); Tomoko Narusawa, Hiratsuka (JP); Yoshiyuki Shimada, Fukaya (JP); Hiromasa Mitani, Hiratsuka (JP); Kazuyuki Seino, Fukaya (JP); Takashi Nishimura, Fukaya (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 559 days.

(21) Appl. No.: 11/206,050

(22) Filed: Aug. 18, 2005

(65) Prior Publication Data

US 2006/0049734 A1 Mar. 9, 2006

(30) Foreign Application Priority Data

Aug. 27, 2004 (JP) ..... 2004-248613

(51) Int. Cl.
*H01J 1/50* (2006.01)
*H01J 3/20* (2006.01)
*H01J 3/32* (2006.01)
*H01J 23/10* (2006.01)

(52) U.S. Cl. ..... 313/156; 313/153; 313/160

(58) Field of Classification Search ..... 313/153–162, 313/495–497, 552–553; 417/48–51
See application file for complete search history.

(56) References Cited

U.S. PATENT DOCUMENTS 5,936,342 A 8/1999 Ono et al. ..... 313/495
6,726,520 B2 4/2004 Takeda et al. ..... 445/62
6,827,621 B1 12/2004 Enomoto et al. ..... 445/24

(Continued)

FOREIGN PATENT DOCUMENTS

JP 5-121012 5/1993

(Continued)

OTHER PUBLICATIONS

Machine translation jp5121012, Masanobu, May 18, 1993.*

(Continued)

*Primary Examiner*—Joseph L. Williams
*Assistant Examiner*—Bumsuk Won
(74) *Attorney, Agent, or Firm*—Fitzpatrick, Cella, Harper & Scinto

(57) ABSTRACT

It is an object of the present invention to provide an image display apparatus in which the change over time of its electron source characteristics is small, and in which uneven brightness and color shift of an image is almost unnoticeable. To achieve this object, the present invention is directed to an image display apparatus containing an electron source substrate having a plurality of electron-emitting devices arrayed thereon, an image forming substrate arranged so as to face the electron source substrate and having a phosphor film and an anode electrode film, and magnetic field generating means, wherein a component parallel to the electron source substrate of a magnetic flux density of a magnetic field generated by the magnetic field generating means is not greater than 0.01 Tesla at any location of the electron-emitting devices.

4 Claims, 6 Drawing Sheets

U.S. PATENT DOCUMENTS

| | | | | |
|---|---|---|---|---|
| 6,846,213 | B2 | 1/2005 | Sato | 445/6 |
| 6,848,961 | B2 | 2/2005 | Nomura et al. | 445/24 |
| 7,091,662 | B2 | 8/2006 | Hasegawa et al. | 313/555 |
| 2005/0009433 | A1 | 1/2005 | Nomura et al. | 445/24 |
| 2006/0043865 | A1 | 3/2006 | Gofuku et al. | 313/362.1 |
| 2006/0043866 | A1 | 3/2006 | Tsuda et al. | 313/365 |
| 2006/0043870 | A1 | 3/2006 | Tsuda et al. | 313/495 |
| 2006/0043871 | A1 | 3/2006 | Kamio et al. | 313/495 |
| 2006/0055637 | A1 | 3/2006 | Gofuku et al. | 345/75.2 |

FOREIGN PATENT DOCUMENTS

| | | |
|---|---|---|
| JP | 9-82245 | 3/1997 |
| JP | 2000-133136 | 5/2000 |
| JP | 2000-315458 | 11/2000 |

OTHER PUBLICATIONS

Machine translation jp9213261, Tetsuro, Aug. 15, 1997.*

* cited by examiner

IMAGE DISPLAY APPARATUS HAVING ION PUMP INCLUDING PERMANENT MAGNET

BACKGROUND OF THE INVENTION

1. Field of the Invention

The present invention relates to an image display apparatus employing an electron-emitting device.

2. Related Background Art

In a flat display in which a plurality of electron-emitting devices are arrayed on a flat substrate as an electron source, and an electron beam emitted from the electron source is irradiated at a phosphor which serves as an image forming member on an opposing substrate, whereby an image is displayed by light emitted from the phosphor, it is necessary to maintain to a high vacuum the interior of the vacuum container which encapsulates the electron beam and the image forming member. If the pressure rises in the vacuum container interior due to gases being generated, while the extent of any adverse effects does depend on the type of gas, the electron source is adversely affected and the amount of electrons emitted is decreased, thus rendering it impossible for a bright image to be displayed.

For flat displays especially, gases generated from the image display member accumulate in the vicinity of the electron source before reaching a getter arranged outside of the image display area, thus causing problems characterized by localized pressure rise and the resulting electron source deterioration. Japanese Patent Application Laid-Open No. H09-82245 discloses decreased deterioration or destruction of the devices by providing a getter in the image display region and instantly adsorbing generated gases. Japanese Patent Application Laid-Open No. 2000-133136 discloses a configuration in which a non-evaporating type getter is provided in an image display region and an evaporating type getter is provided outside of the image display region. Further, as disclosed in Japanese Patent Application Laid-Open No. 2000-315458, a series of operations in a vacuum chamber: degassing, getter formation and seal bonding (forming into a vacuum container) has also been devised.

Getters include evaporating type getters and non-evaporating type getters. However, while the exhaust velocity of water or oxygen by an evaporating type getter is extremely large, the exhaust velocity of an inert gas such as argon (Ar) by either an evaporating type getter or a non-evaporating type getter is almost zero. Argon gas is ionized by an electron beam and turned into positive ions, which are accelerated by an electric field whose purpose it is to accelerate electrons, whereby the electron source suffers damage as a result of bombardment of the accelerated ions. In some cases this can cause internal electric discharge, whereby the apparatus can be destroyed.

As an exhaust means which can exhaust noble gases, Japanese Patent Application Laid-Open No. H05-121012 discloses a method wherein a sputtering ion pump is connected to the vacuum container of a flat display for maintaining a high vacuum over a long period of time. As illustrated in FIG. 9, such a thin flat display apparatus comprises a front panel 902 having a fluorescent surface 901 and a container main body 903, which is airtightly sealed therewith and which constitutes a vacuum container 910 together with the front panel 902. An electrode structure 905 is arranged inside this container main body 903. The electrode structure 905 has a field emission cathode, wherein an electron beam emitted from this cathode is modulated by an internal electrode 915 (i.e. a modulating electrode), and directed towards the fluorescent surface 901 for displaying an image. The container main body 903 is connected to an ion pump 908 for vacuum maintenance, whereby the interior of the vacuum container 910 is kept at a pressure of $10^{-6}$ Pa ($10^{-8}$ Torr) or below. As an embodiment of the ion pump 908, 1,000 gauss (0.1 Tesla, hereinafter the unit Tesla of magnetic flux density is indicated by a "T"), for example, is applied using magnetic field generating means 920 for generating a high voltage of from 3 to 5 kV between an anode 912 and a cathode 913, to thereby operate an ion pump 908, whereby an ultra-high vacuum having a pressure of no greater than $10^{-6}$ Pa, about $10^{-8}$ Pa for example, can be attained.

However, magnetic field leaking from the magnetic field generating means 920 acts on the electron beam whose purpose is to display the image, whereby the beam orbit is changed, thereby causing the beam to deviate when arriving at the phosphor from the location where the beam originally would have arrived. Therefore, there are the problems of members other than the phosphor being bombarded, brightness being reduced due to the beam arriving at an adjacent portion of the phosphor, and color shift occurring in a color image.

SUMMARY OF THE INVENTION

It is an object of the present invention to provide an image display apparatus in which uneven brightness and color shift of an image are reduced.

The present invention is directed to an image display apparatus comprising an electron source substrate which comprises a plurality of electron-emitting devices arrayed thereon, an image forming substrate arranged so as to face the electron source substrate which comprises a phosphor film and an anode electrode film, and magnetic field generating means, wherein a component parallel to the electron source substrate of a magnetic flux density of a magnetic field generated by the magnetic field generating means is not greater than 0.01 Tesla at any location of the electron-emitting devices.

DESCRIPTION OF THE PREFERRED EMBODIMENTS

The present invention relates to the following matters.

1. An image display apparatus comprising an electron source substrate having a plurality of electron-emitting devices arrayed thereon, an image forming substrate arranged so as to face the electron source substrate which comprises a phosphor film and an anode electrode film, and magnetic field generating means, wherein a component parallel to the electron source substrate of a magnetic flux density of a magnetic field generated by the magnetic field generating means is not greater than 0.01 Tesla at any location of the electron-emitting devices.

2. The above-described image display apparatus, wherein the magnetic field generating means is a permanent magnet of an ion pump connected to the electron source substrate or the image forming substrate.

3. The above-described image display apparatus, wherein the magnetic field generating means is a single permanent magnet comprising a pair of magnetic poles.

4. The above-described image display apparatus, wherein the magnetic pole direction is approximately perpendicular to the electron source substrate.

5. The above-described image display apparatus, wherein a distance between the magnetic field generating means and a closest electron-emitting device is 5 mm or more.

6. The above-described image display apparatus, wherein the magnetic field generating means is a permanent magnet accompanying a speaker.

According to the present invention, an image display apparatus can be provided in which deflection caused by the magnetic field of a traveling electron beam emitted from an electron source is small and in which uneven brightness and color shift of an image is almost unnoticeable, as a result of the component parallel to the electron source substrate of the magnetic flux density of the magnetic field generated from the magnetic field generating means being no greater than a predetermined intensity at a location of the electron-emitting devices.

In an embodiment using a single permanent magnet having a pair of magnetic poles, even if the permanent magnet has to be directly connected to an electron source or image forming substrate for arranging at a location close to the electron-emitting device, like an ion pump for example, magnetic flux density rapidly decreases away from the permanent magnet, whereby the impact on the electron beam can be reduced.

The present invention has the advantages of an extended electron source life as well as an extended getter life, as the amount of electrons hitting something other than the phosphor is reduced, and because the amount of emitted gas is low.

Preferable embodiments will now be explained in detail with reference to the drawings. In the following explanation, the electron source substrate serves as the rear plate and the image forming substrate serves as the face plate.

Figure 1:
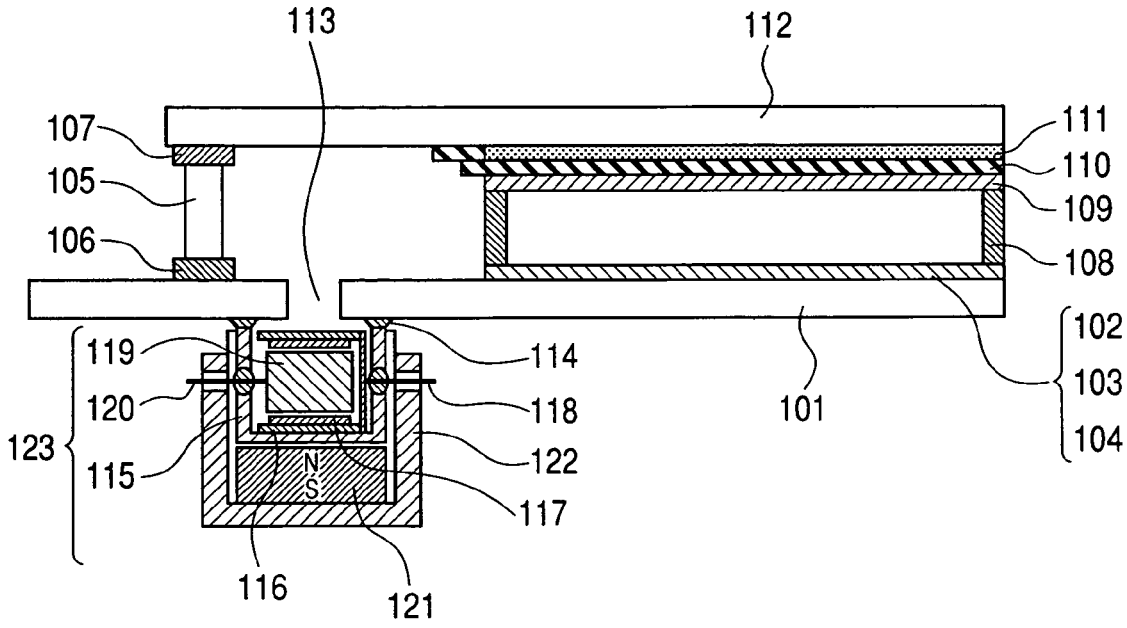
FIG. 1 is a schematic diagram illustrating the configuration of the image display apparatus according to the present invention.

FIG. 1 is one example of a schematic diagram illustrating the configuration of an image display apparatus according to the present invention. As illustrated in FIG. 1, a rear plate 101 comprises upper wiring 102 and lower wiring 103 formed on an inner side of a substrate such as glass, and a plurality of surface conducting electron-emitting devices 104 which act as an electron source. On a face plate 112 are formed a phosphor film 111, a metal backing film 110 which acts as an anode electrode film and a getter film 109 on an inner side of a transparent glass substrate. A support frame 105 is joined with the rear plate 101 by a joining member 106, and joined with the face plate 112 by a joining member 107, whereby a package is formed which acts as a vacuum container. The plurality of spacers 108 are atmospheric pressure supporting members.

An ion pump 123 is joined to an exhaust port 113 of the rear plate 101 by a portion of an ion pump container 115 and a joining member 114 made of frit glass or the like. The ion pump container 115 encapsulates a cylindrical anode electrode 119 and an opposing cathode electrode 116, and comprises an anode connecting terminal 120 and a cathode connecting terminal 118. A metal plate 117 is arranged on the cathode electrode 116. A permanent magnet 121 attached to a yoke 122 at the location of the magnetic field generating means is provided on the outer side of the ion pump container 115. The anode connecting terminal 120 and cathode connecting terminal 118 are vacuum sealed terminals for supplying a high voltage to the anode electrode 119 and the cathode electrode 116.

Figure 2A:
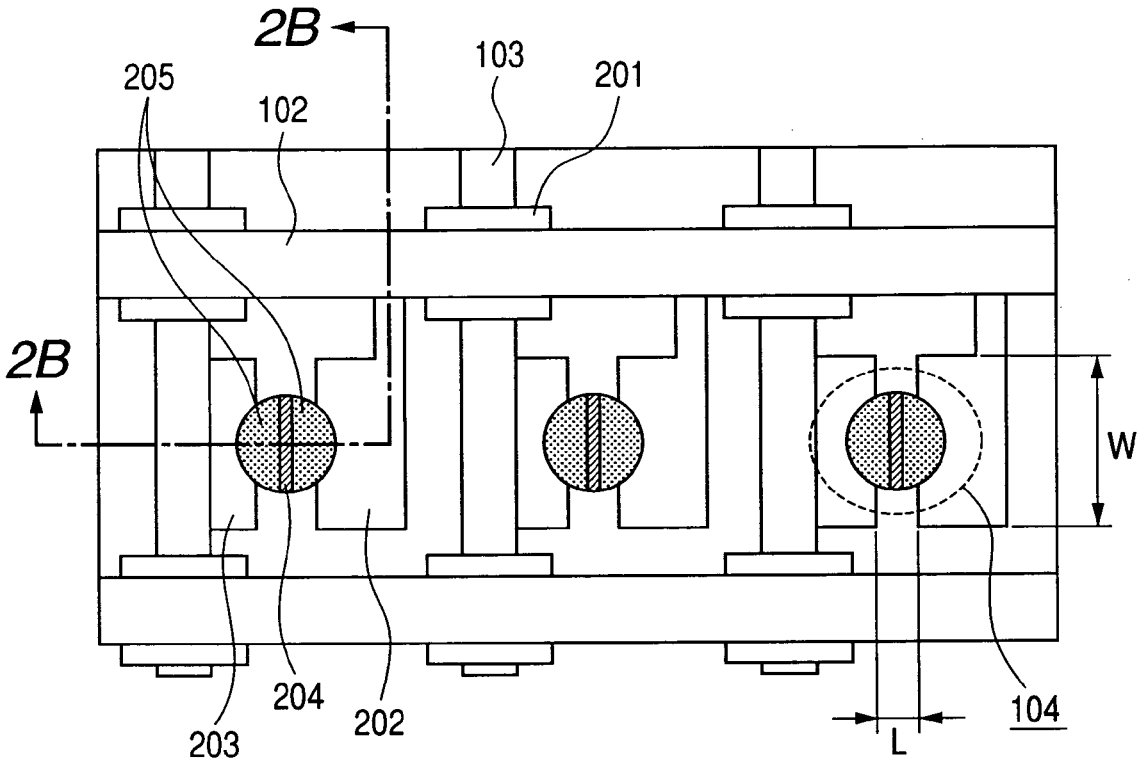
FIGS. 2A and 2B are diagrams illustrating a power source.

FIG. 2A is a schematic diagram illustrating surface conducting electron-emitting devices 104 arranged on the rear plate 101, and a portion of the wiring etc. for driving the electron source of the surface conducting electron-emitting devices. FIG. 2A shows lower wiring 103, upper wiring 102 and an interlayer insulating film 201 for electrically insulating the upper wiring 102 from the lower wiring 103.

Figure 2B:
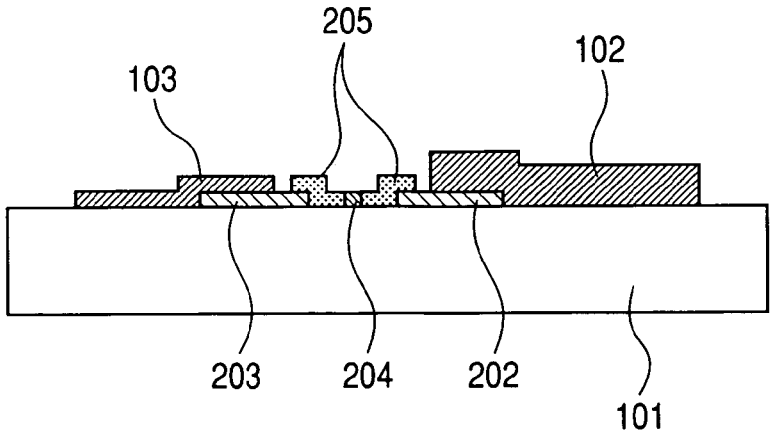

FIG. 2B illustrates an expanded cross-section along the line 2B-2B of the structure of a surface conducting electron-emitting device 104 in FIG. 2A, wherein device electrodes 202 and 203, conductive thin-film 205 and electron-emitting member 204 etc. are shown.

In the configuration according to FIG. 1, an ordinary glass substrate or a glass substrate with $SiO_2$ or other multifunctional film formed on its surface can be employed as the rear plate 101 and the face plate 112.

As the material for the device electrodes (corresponding to reference numerals 202 and 203 in FIGS. 2A and 2B) of the surface conducting electron-emitting devices 104, an ordinary conductor may be used. Production can be carried out by either depositing an electrode material by vacuum deposition, sputtering, chemical vapor deposition or similar method, then subjecting the deposited material to a photolithography process (including processing techniques such as etching, lift off and the like) to work into a desired shape, or by some other printing technique. In effect, there are no particular restrictions placed on the production method, as long as the shape of a desired device electrode material can be formed into the desired shape.

For the conductive thin-film 205 to attain good electron-emitting characteristics, a fine-particle film constituted of fine particles is preferable. The conductive thin-film 205 is formed by using an inkjet coating apparatus, for example, for coating an organometallic thin film, then subjecting the thin film to heating and baking. Further examples of formation methods for the conductive thin-film 205 include vacuum deposition, sputtering, chemical vapor deposition, dispersion coating, dipping, spinning and the like. Alternatively, processing techniques such as lift off, etching and the like may be used in combination.

The electron-emitting member 204 is a high-resistance fissure formed on a part of the conductive thin-film 205, and is formed by a process called "conduction forming". It is also preferable to subject the device to a process called activation. Next, the array of the plurality of surface conducting electron-emitting devices 104, and, the wiring supplying an electrical signal (power) for image display to these devices will be explained.

As an example, the wiring may be formed using two wires (Y: upper wiring 102, and X: lower wiring 103; these shall be called "simple matrix wiring") which are orthogonal to each other. The upper wiring 102 and lower wiring 103 are each connected to the device electrodes 202 and 203 of the surface conducting electron-emitting devices 104. The upper wiring 102 and lower wiring 103 can be constituted from a conductive metal or similar substance formed by vapor deposition, a printing technique such as screen printing or offset printing, sputtering or such method. The materials, film thickness and width may be selected as appropriate. Among the above methods, a printing technique is preferable due to low production costs and handling simplicity. In places where the upper wiring 102 and lower wiring 103 overlap, the wiring sandwiches an interlayer insulating film 201, whereby electrical insulation is achieved. The interlayer insulating film 201 can be produced using the same production methods as the production methods for the upper wiring 102 and lower wiring 103.

When the phosphor film 111 coated on an inner side of the face plate 112 is monochrome, the structure only consists of a single phosphor. When displaying a color image, a structure is employed in which a phosphor which emits light in the three primary colors of red, green and blue is separated by a black conductor. Depending on its shape, the black conductor is called black stripe, black matrix etc. Production methods include a photolithography process using a phosphor slurry, or a printing process, whereby patterning is carried out on a pixel of a desired size, for forming a phosphor of each of the colors.

On the phosphor film 111 is formed a metal backing film 110 which acts as an anode electrode film. The metal backing film 110 is constituted from a conductive thin film, such as aluminum. Of the light emitted by the phosphor film 111, the metal backing film 110 reflects light which is proceeding towards the rear plate 101, and thereby increases brightness. The metal backing film 110 also confers conductivity to the image display region of the face plate 112, thereby preventing charge from accumulating. Furthermore, the metal backing film 110 serves as the anode electrode for the surface conducting electron-emitting devices 104 of the rear plate 101. Because the metal backing film 110 is applied with a high voltage, it is electrically connected to a high-voltage application apparatus.

The joining member 107 for joining the support frame 105 with the face plate 112, and the joining member 106 for joining the support frame 105 with the rear plate 101, are preferably made from a low-melting point metal such as indium, an alloy or frit glass which are capable of vacuum sealing. In other words, as long as vacuum sealing can be maintained, no restrictions are placed on the means for achieving this.

The joint between the ion pump container 115 and the rear plate 101 is also preferably a low-melting point metal such as indium, an alloy or frit glass which are capable of providing a vacuum-tight joint. In a similar fashion, as long as a vacuum-tight joint can be maintained, no restrictions are placed on the means for achieving this.

Examples of a material which can be employed for the getter film 109 include a metal such as Ba, Mg, Ca, Ti, Zr, Hf, V, Nb, Ta, W and the like, and an alloy of these materials.

The purpose of the spacer 108 is to provide support so that the image display apparatus is not destroyed as a result of atmospheric pressure, and therefore the spacers possess an appropriate level of mechanical strength, sufficient electrical breakdown voltage and electrical characteristics such that they are not adversely affected by an electron beam.

The surface of the cathode electrode 116 of the ion pump 123 is provided with an opposing metal plate 117 made of Ti, Ta or similar which is for increasing adsorption efficiency. While a metal or an alloy can be can be used as the material for the cathode electrode 116 and the anode electrode 119, stainless steel is preferable due to its emitted gas characteristics and oxidation resistance. Materials for the ion pump container 115 can include glass, a metal, ceramics and the like, wherein as long as the material can be maintained in a vacuum and passed through a magnetic filed, no particular restrictions are placed thereon.

The magnet 121 is preferably a permanent magnet consisting of a material such as ferrite, samarium-cobalt alloy, neodymium alloy, alnico alloy and the like. As illustrated in the drawings, the magnet 121 is preferably attached to a yoke 122, whereby magnetic flux leakage can be reduced. In the space enclosed by the cathode electrode 116 and the anode electrode 119, it is preferable to generate a magnetic field having a magnetic flux density of no less than 0.08 T.

Once a portion of the magnetic field generated from the magnet reaches the electron beam, the orbit of the electron beam is changed. Since the main part of the electron beam runs perpendicularly from the rear plate 101 towards the face plate 112, the component perpendicular to the rear plate 101 of the magnetic field has hardly any effect on the orbital of the electron beam. Therefore, if distortion of the electron beam is a problem, it is sufficient to adopt a magnetic flux density component that is parallel to the rear plate. In view of this, it was found from an investigation into the effects of a magnetic field on an image that 48 out of 50 people judged the effects on an image were not a problem when the magnetic flux density component parallel to the rear plate was 0.01 T at the electron-emitting device location.

In the present invention the component parallel to the rear plate of the magnetic flux density of the magnetic field generated from the magnet is constituted so as to be no greater than 0.01 T at the location of the electron-emitting device.

In a conventional ion pump, two permanent magnets serve as a pair, wherein the magnets are arranged on the circumference of the ion pump container 115 so as to attract each other, and such that the axis of the cylindrical anode electrode 119 is parallel to the direction of the magnetic flux density. In this manner, a uniform magnetic flux density can be achieved over a broad range of the space enclosed by the cathode electrode 116 and the anode electrode 119, and, exhaust velocity is improved as the opportunities for ionization increase. In contrast, in an embodiment according to the present invention, one permanent magnet having a pair of magnetic poles is employed. If a single permanent magnet is used, the uniform magnetic flux density region narrows, whereby although exhaust velocity decreases, the impact on an electron beam for an image display is somewhat alleviated since magnetic flux density rapidly decreases away from the magnet 121. The yoke 122 material is preferably iron, nickel, or an alloy such as permalloy. It is particularly preferable for the direction of the magnetic poles (SN orientation) of the ion pump permanent magnet to be set as perpendicular as possible to the rear plate, as illustrated in FIG. 1, so that the magnetic flux density in a direction parallel to the rear plate is reduced. The direction of the magnetic poles should be, for example, in a range of 90°±45°, preferably in a range of 90°±30°, more preferably in a range of 90°±15°, and most preferably is approximately perpendicular (range of 90°±5°).

According to such a configuration, while generating a magnetic field having a magnetic flux density of 0.08 T or more in the space enclosed by the cathode electrode 116 and the anode electrode 119, the component parallel to the rear plate of the magnetic flux density can easily be made to be no greater than 0.01 T at the location of the electron-emitting device. At such time, the distance from the yoke to the nearest electron-emitting device can be selected in a range of 5 mm or more, and preferably from 10 mm or more.

A voltage of from 1 kV to 10 kV is applied to the anode electrode 119 and the cathode electrode 116 via the anode connecting terminal 120 and cathode connecting terminal 118 in a manner such that the anode electrode becomes positive. Increasing the applied voltage exacerbates negative effects such as greater power consumption and being forced to reliably provide insulation measures. Thus, the voltage for efficiently driving the ion pump 123 is preferably between 2 and 5 kV. On applying such voltage, the electrons remaining in the space enclosed by the anode electrode 119 and the cathode electrode 116 induce electric discharge. Positive ions in the residual gas generated by the electric discharge bombard the metal plate 117 on the cathode electrode 116, whereby the substance (e.g. Ti or similar) constituting the metal plate 117 is sputtered. The sputtered metal is active and chemically adsorbs the residual gas, and thus can act as a vacuum pump. Further, the ions are implanted onto the cathode electrode 116 and the metal plate during bombardment, lose their charge and turn into neutral particles, and thus the particles are redirected so that they are also implanted on the anode electrode 119. In addition, since the ions are buried by the sputtered substance, such ions cannot easily escape, thus allowing a noble gas such as argon to be exhausted.

In the above-described configuration, the above-described voltage is applied to the ion pump 123, to thereby apply a scanning signal and a modulation signal, which act as the image signal, to the surface conducting electron-emitting devices 104 via a scanning drive circuit (not shown) connected to the upper wiring 102 and a modulation drive circuit (not shown) connected to the lower wiring 103. As a result, an electron beam is generated which conforms to the electric signal from the surface conducting electron-emitting devices 104. This beam is accelerated by a high voltage (1 to 15 kV) applied to the metal backing film 110 and the phosphor film 111, and bombards the phosphor film 111, whereby a phosphor is emitted to thereby display an image.

Once an image is displayed, gases are emitted from portions being bombarded with electrons. Among such gases, gases such as $H_2$, $O_2$, CO, $CO_2$, $H_2O$ etc., which effect the characteristics of the surface conducting electron-emitting devices 104 are adsorbed on the getter film 109. Meanwhile, while the inert gas argon is not adsorbed on the getter film 109, argon is exhausted by the ion pump 123 attached to the rear plate 101, whereby the argon partial pressure can be kept below the pressure $10^{-6}$ Pa which effects a device, thereby suppressing deterioration of the surface conducting electron-emitting devices 104 from the argon. Accordingly, a long-life image display apparatus having little brightness deterioration can be obtained even for prolonged image display.

The electron source which serves as the electron-emitting means is not particularly restricted to a flat type formed with surface conducting electron-emitting devices 104 in a flat shape on the surface of the rear plate 101. Other examples include a perpendicular type formed with surface conducting electron-emitting devices on a perpendicular surface on the rear plate 101, or even a thermal electron source employing a heated cathode or an electric field emission type electron-emitting device. In effect, there are no restrictions on the electron-emitting means as long as said means is an element which emits electrons. Furthermore, the present invention can also be applied in an image display apparatus or similar in which the method for supplying power to the electron source, in addition to a simple matrix, employs a control electrode (grid electrode wiring) which controls the electron beam emitted from the electron source to thereby display an image.

In addition to the rear plate 101, the ion pump 123 can also be arranged on the face plate 112. Even in such case, application of the present invention is possible.

Not only for the effects from an ion pump magnet, but in the same way, for the effects of a magnetic field leak from a permanent magnet accompanying a speaker as well, by making the component parallel to the rear plate of the magnetic flux density of the magnetic field to be no greater than 0.01 T at a location of the electron-emitting device, an image display apparatus can be provided in which uneven brightness and color shift are dramatically reduced.

EXAMPLES

Examples of the present invention will now be explained with reference to the drawings. However, the present invention is not limited to these Examples, and is intended to include appropriate changes so long as such changes do not go against the gist of the present invention.

Example 1

This example shall be explained with reference to the image display apparatus illustrated in FIG. 1.

First, the method for producing the package which serves as a vacuum container for the image display apparatus will be explained. Using glass plates (PD-200, manufactured by Asahi Glass Co., Ltd.) having a thickness of 2.8 mm and a size of 240 mm×320 mm as the rear plate 101, and having a thickness of 2.8 mm and a size of 190 mm×270 mm as the face plate 112, a layer of $SiO_2$ (not shown) 500 nm thick was deposited on the electron source side surface of the rear plate 101, and an ITO film (not shown) was deposited to a thickness of 50 nm on the underside. An exhaust port 113 having an 8 mm ϕ (diameter) was provided outside of the image region and inside of the glass frame 105.

The device electrodes 202 and 203 of the surface conducting electron-emitting devices 104 serving as an electron source were produced by depositing platinum onto the above-described rear plate 101 by vapor deposition, then working with a photolithography process (including processing techniques such as etching, lift off and the like), to thereby work into a shape having a film thickness of 100 nm, electrode gap L of 2 μm and a device electrode length W of 300 μm.

Next, upper wiring 102 (100 wires) having a width of 500 μm and a thickness of 12 μm, and lower wiring 103 (400 wires) having a width of 300 μm and a thickness of 8 μm were formed on the rear plate 101 by printing a silver paste ink and then baking. The lead out terminals for the external drive circuit were also produced in the same manner. An interlayer insulation layer 201 was formed to a thickness of 20 μm by printing a glass paste and then baking (baking temperature 550° C.)

Next, the above-described rear plate 101 was washed, and then dispersed with DDS (dimethyldiethoxysilane, manufactured by Shin-Etsu Chemical Co., Ltd.) in a dilute ethyl alcohol solution using a spraying technique. The dispersed rear plate was then dried by heating at 104° C. As the conductive thin-film 205, a 0.15 wt % palladium-proline complex was dissolved in an aqueous solution consisting of 85% water and 15% isopropyl alcohol, and this organic palladium-containing solution was coated using an inkjet coater. The coated solution was then subjected to a heating treatment for 10 minutes at 350° C., whereby a fine particle film consisting of PdO (palladium oxide) was formed, to thereby yield a 40 μm ϕ (diameter) conductive thin-film 104.

A glass plate (PD-200, manufactured by Asahi Glass Co., Ltd.) having a thickness of 2 mm, an outer shape of 150 mm×230 mm and a width of 10 mm was used as the support frame 105. On the face connecting to the rear plate 101, a frit glass LS 7305 (manufactured by Nippon Electric Glass Co., Ltd.) was coated using a dispenser. Baking was carried out by heating at 430° C. for 30 minutes.

Figure 3:
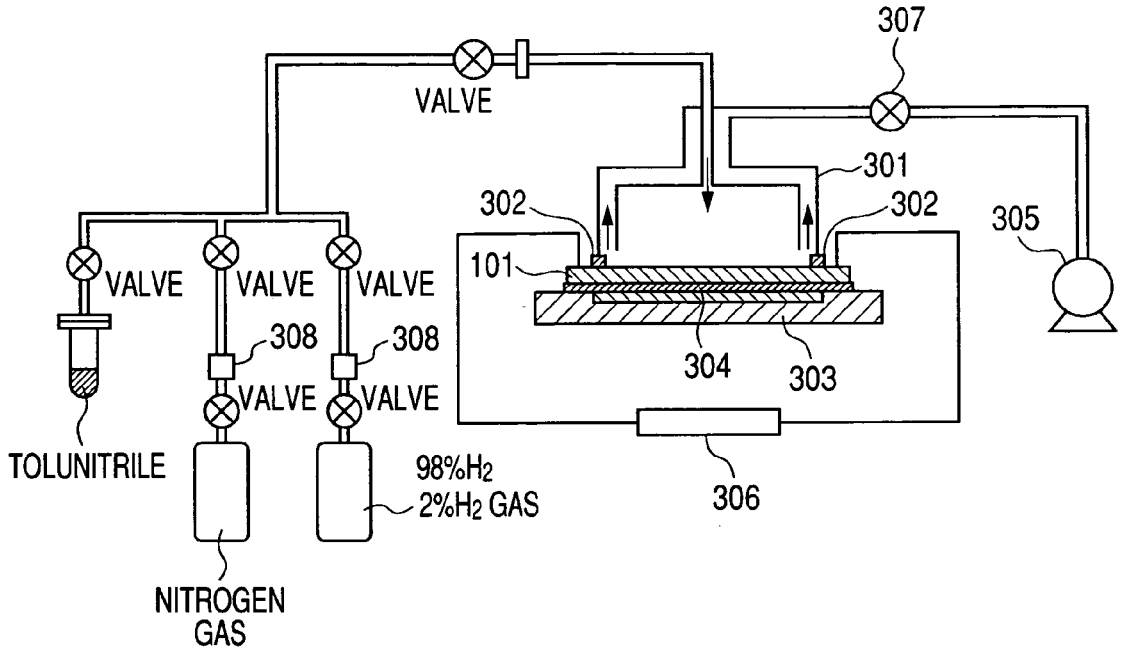
FIG. 3 is a diagram illustrating an apparatus for conducting the forming and activating steps.

Using the vacuum exhaust apparatus illustrated in FIG. 3, the rear plate 101 produced in the above manner was subjected to the below-described forming and activation. First, as illustrated in FIG. 3, the rear plate 101 arranged on the substrate stage 303, except for the discharging electrode (not shown) region, was sealed with O rings 302 and covered by a vacuum container 301. The substrate stage 303 possessed an electrostatic chuck 304 for fixing the rear plate 101 onto the stage, wherein 1 kV was applied between the electrodes of the ITO film (not shown) formed on the underside of the rear plate 101 and the electrostatic chuck interior, whereby the rear plate 101 was held.

The steps subsequent to the forming step were carried out in the following manner. The interior of the vacuum container 301 was exhausted to a pressure of $10^{-4}$ Pa using a magnetically levitated turbomolecular pump 305. A rectangular waveform having a 1 msec pulse width generated using a signal generator 306 was applied in a scroll wave frequency of 10 Hz successively to the upper wiring 102, and the voltage was set at 12 V The lower wiring 103 was earthed to a ground. The vacuum container interior was charged with a mixed gas of hydrogen gas and nitrogen gas (2% $H_2$, 98% $N_2$), and the pressure was maintained at 1,000 Pa. A mass flow controller 308 was used to control the gas charging, while a conductance valve 307 for flow control was used to control the exhausted flow from the vacuum container 301. When the current value flowing in the conductive thin-film 205 had almost reached zero, voltage application was stopped. The $H_2$ and $N_2$ mixed gas in the vacuum container interior was exhausted to thereby complete forming. Cracks were formed on every conductive thin-film 205 of the rear plate 101, whereby an electron-emitting member 204 was produced.

Next, the activation step was carried out. The vacuum container interior was exhausted to a pressure of $10^{-5}$ Pa, after which the vacuum container interior was charged with tolunitrile (molecular weight: 117) until the partial pressure reached $1\times10^{-4}$ Pa. A rectangular pulse having a 1 msec pulse width generated by the signal generator 306 was applied to the upper wiring 102, whereby all the surface conducting electron-emitting devices 104 were activated. After activation was completed, the tolunitrile remaining in the vacuum container 301 was exhausted, after which the interior was returned to atmospheric pressure and the rear plate 101 was discharged.

The ion pump container 115 was made from glass (PD-200, manufactured by Asahi Glass Co., Ltd.) which had been fabricated in a size of W 30 mm×D 30 mm×H 30 mm. The ion pump container 115 encapsulated a cylindrical anode electrode 119 made from SUS 304 stainless steel and an opposing flat cathode electrode 116. A titanium metal plate 117 was provided in the center portion of the cathode electrode 116. The cathode electrode 116 and the anode electrode 119 were respectively connected to a cathode connecting terminal 118 and an anode connecting terminal 120. The cathode connecting terminal 118 and the anode connecting terminal 120 were constituted from Dumet wire, and held by a vacuum density maintained by the ion pump container 115 and frit, thus forming a structure for discharging to the outside.

Next, the frit glass VS-2 (manufactured by Nippon Electric Glass Co., Ltd.) which had been formed into a paste with an organic binder was coated using a dispenser onto locations (4 sides) of the ion pump container 115 joined with the rear plate 101. Each ion pump container 115 was heated for 30 minutes at 400° C. for carrying out the above-described pre-baking, and then further heated for 3 hours at 480° C. in a vacuum for carrying out degassing. In a vacuum baking furnace having a pressure of $10^{-4}$ Pa, the above-described ion pump container 115 and the rear plate 101 were pre-fixed to a desired location. While applying a pressure of 5,000 Pa to both of these components, heating was carried out for 80 minutes at 390° C., whereby they were joined by a joining member 114 consisting of frit.

Next, indium was coated on the support frame 105, and a spacer 108 was arranged for each 20 lines on the upper wiring 102. The spacers 108 were provided with an insulating mount externally to the image display area, and were fixed by adhering with Aron Ceramic W (manufactured by Toagosei Co., Ltd.).

Meanwhile, on the face plate 112, striped phosphors (R, G, B) and a black conductor (black stripe) were alternately formed as the phosphor film 111. The face plate 112 was also formed with a metal backing film 110 made from an aluminum thin-film having a thickness of 200 nm. Next, a joining member 107 consisting of indium was coated on a silver paste pattern (not shown) that had been provided in advance on a face plate 112 circumference portion.

Figure 4:
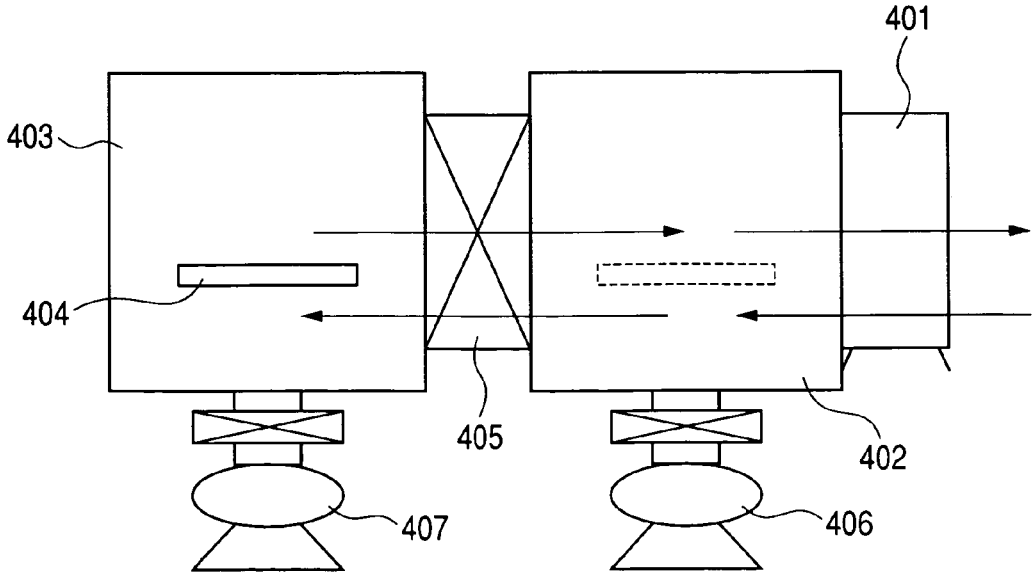
FIG. 4 is a schematic block diagram of a vacuum processing apparatus.
Figure 5:
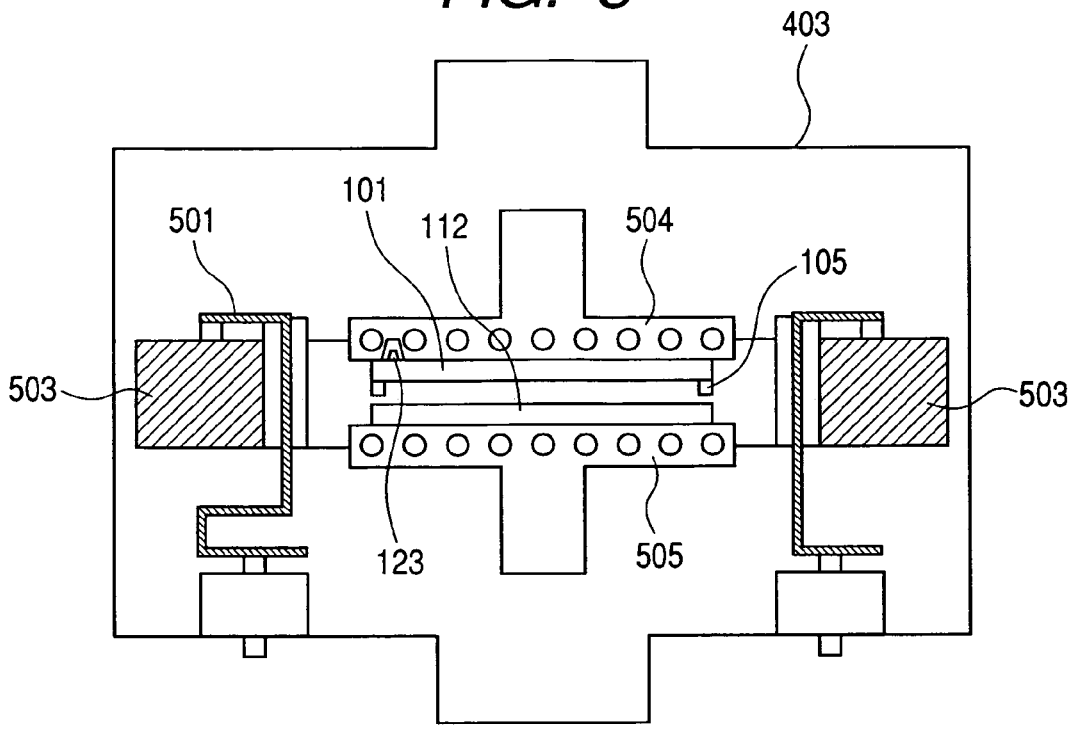
FIG. 5 is a diagram illustrating the steps of baking, getter flashing and seal bonding which are carried out in the vacuum processing apparatus.

The rear plate 101, which joined the above-described support frame 105 and the ion pump container 120, and the face plate 112 were set on a transfer jig 404 of the vacuum processing apparatus illustrated in FIG. 4. A transfer entrance 401 was opened, and the transfer jig was inserted into a load chamber 402. After the transfer entrance 401 was closed, the load chamber 402 was exhausted using a vacuum pump 406 to about $3\times10^{-5}$ Pa. A gate valve 405 was opened, and the transfer jig 404 was transferred into a vacuum processing chamber 403 which had been exhausted in advance using a vacuum pump 407 to about $1\times10^{-5}$ Pa. The gate valve 405 was then closed. Once the transfer jig 404 had occupied its proper position, the rear plate 101 was closely fitted to an upper hot plate 504, and the face plate 112 was closely fitted to the lower hot plate 505, such as those shown in FIG. 5, which were arranged in the vacuum processing chamber 403. Heating was carried out for 1 hour at 300° C.

Next, the rear plate 101 and the portion of the transfer jig 404 supporting the rear plate were raised along with the upper hot plate 504 about 30 cm in an upwards direction. Then, in the space between the rear plate 101 and the face plate 112, one half of a roof-shaped jig 503 was rotated around support member 501 and moved onto the face plate 112. Barium getter containers provided on an inner side roof of the roof-shaped jig 503 were each successively powered with a 12 A current for 10 seconds, whereby a 50 nm thick barium film was adhered onto the metal backing film 110 of the face plate 112. The roof-shaped jig 503 was returned to its original position, and the other half of the roof-shaped jig 503 was subjected to the same operation.

Next, the roof-shaped jig 503 was returned to its original position, and the rear plate 101, the support jig which served as a portion of the transfer jig 404, and the upper side hot plate 504 were lowered, and the upper hot plate 504 and the lower hot plate 505 were heated to 180° C. After maintaining at 180° C. for 3 hours, the rear plate 101, the support jig serving as a portion of the transfer jig 404, and the upper side hot plate 504 were lowered still further, and the rear plate 101, the face plate 112 and the support frame 105 were applied with a pressure of 3.9 MPa. Heating was stopped in this state, and the components were allowed to cool to room temperature through natural cooling, to thereby complete seal-binding. The gate valve 405 was opened, and the vacuum container was transferred from the vacuum processing chamber 403 to the load chamber 402. After the gate valve 405 was closed, the pressure in the load chamber was returned to atmospheric pressure. The sealed container was then transferred from the transfer entrance 401. Absolutely no cracks, breaks or similar defects were formed in the sealed container which had been produced in this manner.

Next, a magnet 121 made from neodymium (20 mm ϕ (diameter), 20 mm thickness) was fixed to a yoke 122 made from soft-iron and then fixed to a circumference of the ion pump container 115. At such time, the center portion between the cathode electrodes 116 was made to have a magnetic flux density of 0.12 T. At this time, the component parallel to the rear plate 101 of the magnetic flux density was 0.01 T at a location of the surface conducting electron-emitting device 104 closest to the magnet 121.

Next, a 10 kV direct-current voltage was applied to the metal backing film 110 from a high-voltage power source (not shown). The anode connecting terminal 120 and the cathode connecting terminal 118 of the ion pump 123 were applied with 3 kV in a manner such that the anode electrode 119 was positive. A scanning signal and a modulation signal acting as the image signal were applied to the surface conducting electron-emitting devices 104 from a scanning drive circuit (not shown) connected to the upper wiring 102 and a modulation drive circuit (not shown) connected to the lower wiring 103, to thereby display an image. Even at the image region closest to the ion pump 123, 48 out of 50 evaluators found that uneven brightness and color shift of the image were not a problem.

As explained above, the image display apparatus produced in this Example according to the present invention showed improved unevenness and color shift of an image and long life as a result of argon being exhausted by an ion pump. In addition, such apparatus encapsulated the ion pump within a glass housing joined by frit to the underside of the rear plate, thereby possessing the characteristics of no leaks generated, compactness, light weight, high reliability and low cost.

Example 2

Figure 6:
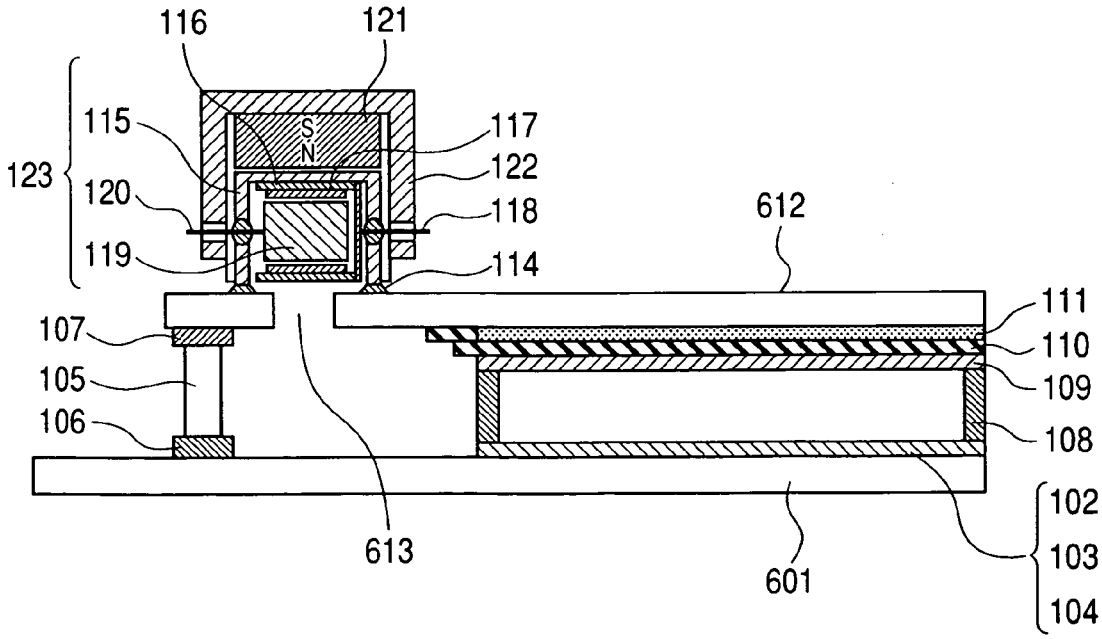
FIG. 6 is a schematic diagram illustrating one embodiment of the image display apparatus according to the present invention.

In this Example, as illustrated in FIG. 6, an example wherein the ion pump 123 is arranged on a face plate 612 will be explained. As illustrated in FIG. 6, the exhaust port 613 is open to the face plate 112. Other than that, the members having reference numerals the same as those for members which have been illustrated in the preceding figures represent the same members. First, the method for producing a package which serves as the vacuum container of the image display apparatus will be described.

Except for not having an exhaust port, the rear plate 601 was the same as that in Example 1. Next, in the same manner as in Example 1, surface conducting electron-emitting devices 104, upper wiring 102 and lower wiring 103 were formed on the rear plate 601, and a support frame 105 the same as in Example 1 was seal-bonded thereto. Forming and activation were carried out in the same manner as in Example 1. Indium was subsequently coated onto the support frame 105, and spacers 108 were arranged on the upper wiring 102 in the same manner as in Example 1.

A face plate 612 the same as that in Example 0.1 was used, except that an 8 mm ϕ (diameter) exhaust port 613 was provided outside of the image region and inside of the outer frame 105. Also in the same manner as Example 1, a phosphor film 111, a black conductor, and a metal backing film 110 were produced, and the same ion pump container 115 as that in Example 1 was joined onto the exhaust port 613 of the face plate 612 using the same method as that in Example 1. Indium 107 was coated onto a silver paste pattern formed in advance on a face plate 612 circumference portion. Indium was also coated onto the support frame 105.

Next, the rear plate 601 joined to the support frame 105 was joined to the face plate 612 joined to the ion pump container 115 in the same manner as in Example 1 using the vacuum processing apparatus illustrated in FIG. 4. Absolutely no cracks, breaks or similar defects were formed in the sealed container which had been produced in this manner.

Next, in the same manner as in Example 1, a magnet 121 was fixed to a yoke 122. At this time, the component parallel to the rear plate 101 of the magnetic flux density at a location of the surface conducting electron-emitting device 104 closest to the magnet 121 was 0.008 T.

Next, a 10 kV direct-current voltage was applied to the metal backing film 110 from a high-voltage power source (not shown). The anode connecting terminal 120 and the cathode connecting terminal 118 of the ion pump 123 were applied with 3 kV in a manner such that the anode electrode 119 was positive. A scanning signal and a modulation signal acting as the image signal were applied to the surface conducting electron-emitting devices 104 from a scanning drive circuit (not shown) connected to the upper wiring 102 and a modulation drive circuit (not shown) connected to the lower wiring 103, to thereby display an image. Even at the image region closest to the ion pump 123, 49 out of 50 evaluators found that uneven brightness and color shift of the image were not a problem.

Example 3

Figure 7:
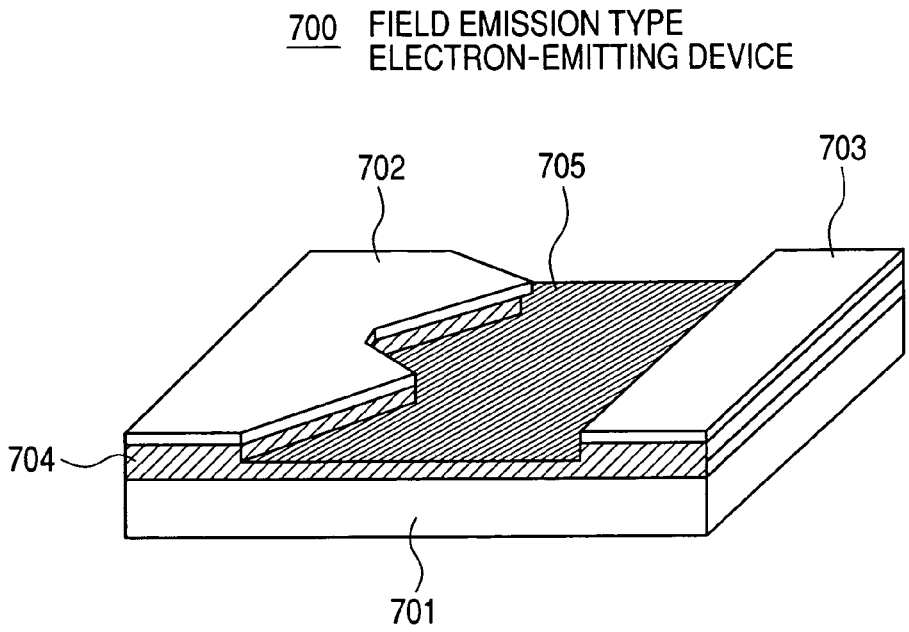
FIG. 7 is a schematic diagram of a field emission type electron-emitting device.

In this Example, as illustrated in FIG. 7, an example wherein a field emission type electron-emitting device 700 is used as the electron source will be explained. As illustrated in FIG. 7, on a insulating layer 704 which was above a rear plate 701 are formed a negative electrode 702, a positive electrode 703, and an electron-emitting member 705 for emitting electrons at a tip thereof made into an acute angle, to thereby constitute a field emission type electron-emitting device 700. In such a constitution, if voltage is applied to the negative electrode 702 and the positive electrode 703 so that the positive electrode 703 has a higher potential, the electric field concentrates at the electron-emitting member 705, whereby electrons are emitted from the electron-emitting member 705 due to the tunnel effect.

The method for producing the image display apparatus according to the present example will now be explained. Using the same substrate as that in Example 1 for the rear plate 701, a field emission type electron-emitting device 700 was formed on the rear plate 701. Molybdenum having a thickness of 0.3 μm was used for the negative electrode 702 and positive electrode 703. The point angle of the electron-emitting member 705 was 45°. The electron source corresponding to one pixel possessed 100 electron-emitting members 705. As the insulating layer 704, $SiO_2$ having a thickness of 1 μm was used. The molybdenum and $SiO_2$ were deposited by a sputtering method, and the processing was carried out using a photolithography process (including processing techniques such as etching, lift off and the like). Next, in the same manner as in Example 1 and using the same methods as Example 1, upper wiring 102 and lower wiring 103 having the same structure and members were formed. A part of the positive electrode 703 was formed so as to be electrically connected to the lower wiring 103, while a part of the negative electrode 702 was formed so as to be electrically connected to the upper wiring 102. Next, in the same manner as in Example 1, and using the same structure and members, a rear plate 701 joined to the same ion pump container 115 and a face plate (not shown) were produced. The rear plate 701 was joined to the face plate in the same manner as in Example 1 using the vacuum processing apparatus illustrated in FIG. 4. Absolutely no cracks, breaks or similar defects were formed in the sealed container which had been produced in this manner.

Next, in the same manner as in Example 1, a magnet 121 was fixed to a yoke 122. At this time, the component parallel to the rear plate 701 of the magnetic flux density at a location of the field emission type electron-emitting device 700 closest to the magnet 121 was 0.009 T.

Next, a 10 kV direct-current voltage was applied to the metal backing film 110 from a high-voltage power source (not shown). The anode connecting terminal 120 and the cathode connecting terminal 118 of the ion pump 123 were applied with 3 kV in a manner such that the anode electrode 119 was positive. A scanning signal and a modulation signal acting as the image signal were applied to the field emission type electron-emitting device 700 from a scanning drive circuit (not shown) connected to the upper wiring 102 and a modulation drive circuit (not shown) connected to the lower wiring 103, to thereby display an image. Even at the image region closest to the ion pump 123, 49 out of 50 evaluators found that uneven brightness and color shift of an image were not a problem.

Example 4

Figure 8:
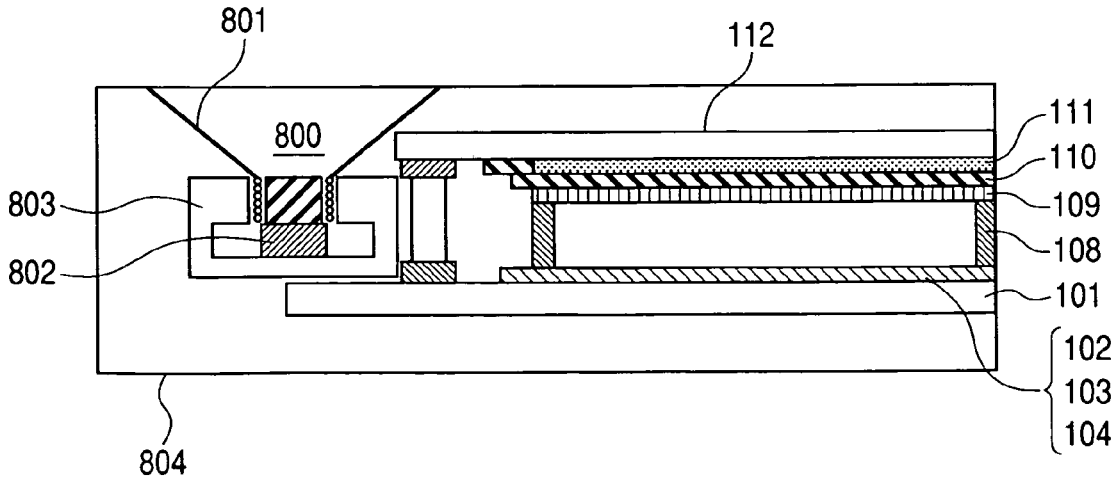
FIG. 8 is a schematic diagram illustrating an example provided with a speaker.
Figure 9:
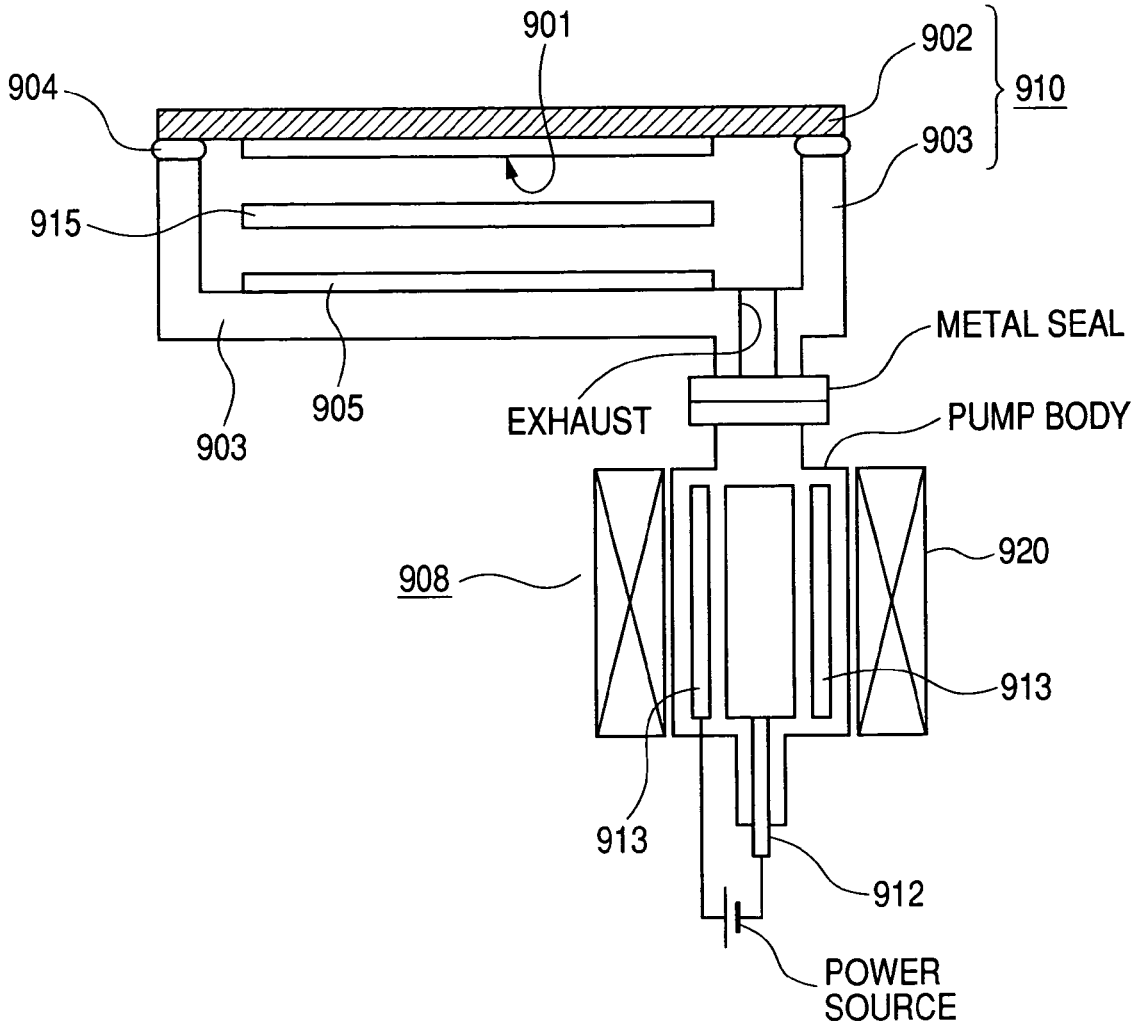
FIG. 9 is a diagram illustrating the conventional art.

In this Example, as illustrated in FIG. 8, an example wherein a speaker was provided for converting an audio signal to sound will be explained. As illustrated in FIG. 8, a speaker 800 comprising an oscillating member 801, a magnet 802 and a yoke 803 was attached to a case 804 of the image display apparatus. Although provided, the ion pump 123 is not shown in FIG. 8. In addition, the members having reference numerals the same as those for members which have been illustrated in the preceding figures represent the same members. First, except for the speaker 800, an image display apparatus was produced in the same manner as in Example 1. A speaker 800 was then installed. At this time, the component parallel to the rear plate 101 of the magnetic flux density at a location of the surface conducting electron-emitting device 104 closest to the magnet 802 was 0.008 T. A case 804 was then mounted.

Next, a 10 kV direct-current voltage was applied to the metal backing film 110 from a high-voltage power source (not shown). The anode connecting terminal 120 and the cathode connecting terminal 118 of the ion pump 123 were applied with 3 kV in a manner such that the anode electrode 119 was positive. A scanning signal and a modulation signal acting as the image signal were applied to the surface conducting electron-emitting devices 104 from a scanning drive circuit (not shown) connected to the upper wiring 102 and a modulation drive circuit (not shown) connected to the lower wiring 103, to thereby display an image. Even at the image region closest to the speaker 800, 48 out of 50 evaluators found that uneven brightness and color shift of the image were not a problem.

As explained in the above, in the image display apparatus according to the present invention, by making the component parallel to the rear plate among the magnetic flux density at the location of the electron-emitting means to be no greater than 0.01 T, impact against the electron orbital is reduced, thereby allowing an image display apparatus to be provided in which uneven brightness and color shift of an image cannot be perceived. In addition, because an ion pump or speaker which have a magnet can be located as close as limits allow, a compact image display apparatus can be provided.

This application claims priority from Japanese Patent Application No. 2004-248613 filed on Aug. 27, 2004, which is hereby incorporated by reference herein.

What is claimed is:

1. An image display apparatus comprising an electron source substrate having a plurality of electron-emitting devices arrayed thereon, an image forming substrate arranged so as to face the electron source substrate and having a phosphor film and an anode electrode film, and magnetic field generating means, wherein a magnitude of a component parallel to the electron source substrate of a magnetic flux density of a magnetic field generated by the magnetic field generating means is not greater than 0.01 Tesla at any location of the electron-emitting devices, the magnetic field generating means is a permanent magnet of an ion pump connected to the electron source substrate or the image forming substrate, and the magnetic field generating means is a single permanent magnet comprising a pair of magnetic poles.

2. The image display apparatus according to claim 1, wherein the magnetic pole direction is approximately perpendicular to the electron source substrate.

3. An image display apparatus comprising an electron source substrate having a plurality of electron-emitting devices arrayed thereon, an image forming substrate arranged so as to face the electron source substrate and having a phosphor film and an anode electrode film, and magnetic field generating means, wherein a magnitude of a component parallel to the electron source substrate of a magnetic flux density of a magnetic field generated by the magnetic field generating means is not greater than 0.01 Tesla at any location of the electron-emitting devices, and a distance between the magnetic field generating means and a closest electron-emitting device is 5 mm or more.

4. An image display apparatus comprising an electron source substrate having a plurality of electron-emitting devices arrayed thereon, an image forming substrate arranged so as to face the electron source substrate and having a phosphor film and an anode electrode film, and magnetic field generating means, wherein a magnitude of a component parallel to the electron source substrate of a magnetic flux density of a magnetic field generated by the magnetic field generating means is not greater than 0.01 Tesla at any location of the electron-emitting devices, and the magnetic field generating means is a permanent magnet accompanying a speaker.

* * * * *